US006283233B1

(12) United States Patent
Lamine et al.

(10) Patent No.: US 6,283,233 B1
(45) Date of Patent: Sep. 4, 2001

(54) DRILLING AND/OR CORING TOOL

(75) Inventors: Etienne Lamine, Court-Saint-Etienne; Sebastian Desmette, Soignies; Cécile Josse, Hoves, all of (BE)

(73) Assignee: Dresser Industries, Inc, Carrollton, TX (US)

( * ) Notice: Subject to any disclaimer, the term of this patent is extended or adjusted under 35 U.S.C. 154(b) by 0 days.

(21) Appl. No.: 09/319,491

(22) PCT Filed: Dec. 16, 1997

(86) PCT No.: PCT/BE97/00136

§ 371 Date: Jul. 19, 1999

§ 102(e) Date: Jul. 19, 1999

(87) PCT Pub. No.: WO98/27311

PCT Pub. Date: Jun. 25, 1998

(30) Foreign Application Priority Data

Dec. 16, 1996 (BE) ..... 09601042

(51) Int. Cl.[7] ..... E21B 10/46; E21B 10/48

(52) U.S. Cl. ..... 175/431; 175/405.1

(58) Field of Search ..... 15/431, 430, 428, 15/405.1

(56) References Cited

U.S. PATENT DOCUMENTS

| | | | | |
|---|---|---|---|---|
| 4,471,845 | * | 9/1984 | Jurgens | 175/431 |
| 4,889,017 | * | 12/1989 | Fuller et al. | 76/108 A |
| 4,942,933 | * | 7/1990 | Barr et al. | 175/431 |
| 4,981,184 | | 1/1991 | Knowlton et al. . | |
| 4,991,670 | | 2/1991 | Fuller et al. . | |
| 5,186,268 | * | 2/1993 | Clegg | 175/399 |
| 5,222,566 | * | 6/1993 | Taylor et al. | 175/431 |
| 5,244,039 | * | 9/1993 | Newton, Jr. et al. | 175/431 |
| 5,314,033 | * | 5/1994 | Tibbitts | 175/431 |
| 5,337,844 | * | 8/1994 | Tibbitts | 175/434 |
| 5,505,272 | * | 4/1996 | Clark | 175/405.1 |
| 5,531,281 | * | 7/1996 | Murdock | 175/431 |
| 5,720,357 | * | 2/1998 | Fuller et al. | 175/428 |
| 5,816,346 | * | 10/1998 | Beaton | 175/376 |
| 5,957,227 | * | 9/1999 | Besson et al. | 175/393 |

FOREIGN PATENT DOCUMENTS

| | | |
|---|---|---|
| 1218567 | 5/1960 | (FR) . |
| 2620487 | 3/1989 | (FR) . |
| 2204625A | 11/1988 | (GB) . |

* cited by examiner

*Primary Examiner*—Hoang Dang
(74) *Attorney, Agent, or Firm*—Browning Bushman P.C.

(57) ABSTRACT

A drill and/or core tool, in particular for oil drilling and/or coring, comprising a body (2) showing a substantially cylindrical peripheral surface (3) and a front (4), blades (5) which extend from the front (4) till over the peripheral surface (3) and which show each a leading edge (6), possibly PDC cutting elements (7) which are situated at least in a central area (15A) of the front (4) and the longitudinal axes of which are transverse to the rotation axis of the tool (1), and comprising moreover, on at least one blade (5), outside said central area (15A): PDC (7C) and/or secondary (10) cutting elements which show each a cutting edge (8), forming together the leading edge (6) of the blade (5), and the longitudinal axis of which is transverse to the rotation axis, and at least one associated cutting element (10A) which is situated behind at least one of the PDC (7C) or secondary (10) cutting elements, which shows a cross-section of the same shape, at least for its portion protruding from the blade (5), than that of the PDC (7C) or secondary (10) cutting element, and which is disposed on the same blade (5).

55 Claims, 3 Drawing Sheets

DRILLING AND/OR CORING TOOL

The present invention concerns a drill and/or core tool in particular for oil drilling and/or coring, comprising:

- a body showing a substantially cylindrical peripheral surface and a front, considered in a movement direction during drilling and/or coring,
- blades which extend from the front till over the peripheral surface and which show each a leading edge for the drilling and/or coring,
- possibly Polycrystalline Diamond Compacts (PDC) cutting elements which are situated at least in a central area of the front and the longitudinal axes of which are transverse to the rotation axis of the tool, and
- nozzles for supplying a drilling liquid.

There is a constant need to increase the efficiency of such tools so that their penetration speeds in the formations to be drilled or cored are the fastest without reducing the life of the tool, i.e. without unnecessarily increasing the weight to which it is subjected to drive it forwards during the operation.

Research is at the same time done to increase an average penetration rate, to increase the time during which a tool can be kept operative in a same drill and/or core hole so as to avoid time wasted for raising the tool up again, controlling, possibly replacing it and for resuming the drilling and/or coring operation.

An object of the present invention is to improve the presently known drilling and/or coring conditions and proposes to this end a tool which provides, on the one hand, a particularly advantageous and economic arrangement of the blades and cutting elements to avoid unnecessarily crushing again of fragments detached from the formation and which provides, on the other hand, a reserve of cutting elements which will practically only be used and acted upon if necessary, for example in case a cutting element, possibly a PDC element, situated on a leading edge is torn away.

To this end, said tool comprises according to the invention moreover, on at least one blade, outside said central area,

- PDC cutting elements and/or secondary cutting elements which show each a cutting edge, forming together the leading edge of the blade, and the longitudinal axis of which is transverse to the rotation axis, and
- at least one associated cutting element
  - which is situated, when considering a drilling rotation of the tool, behind at least one of the PDC or secondary cutting elements,
  - which shows a cross-section of the same shape, at least for its portion protruding from the blade, than that of the PDC or secondary cutting element,
  - which is disposed on the same blade and
  - an edge of which destined for cutting is situated at the most on a same radial distance from the rotation axis and at least on a same distance, measured parallel to this rotation axis starting from a plane perpendicular to this axis and situated in front of the tool, than the cutting edge of said PDC or secondary element.

According to an embodiment of the invention, the leading edge of the blades has the shape of a helix with a possibly variable radius and which turns, at least along said peripheral surface, either in the direction opposite to the drilling rotation or in the same direction as it moves away from the front.

According to a particular embodiment of the invention, the width of a blade, taken in a projection plane perpendicular to the rotation axis, increases as one moves away from this rotation axis over the front, and/or from this front in the direction of a back of the tool. It may then be advantageous that the number of cutting elements arranged one behind the other on a same blade and on the same of said distances, radial and parallel to the rotation axis, increases progressively, in particular with one element having preferably a length equal to the length of said cutting elements, as the width of the blade increases.

Other details and particularities of the invention will become apparent from the secondary claims and from the description of the drawings which are annexed to the present specification and which illustrate by way of non-limitative examples various embodiments of the invention.

In the different figures, the same reference numerals indicate identical or analogous elements.

Figure 1:
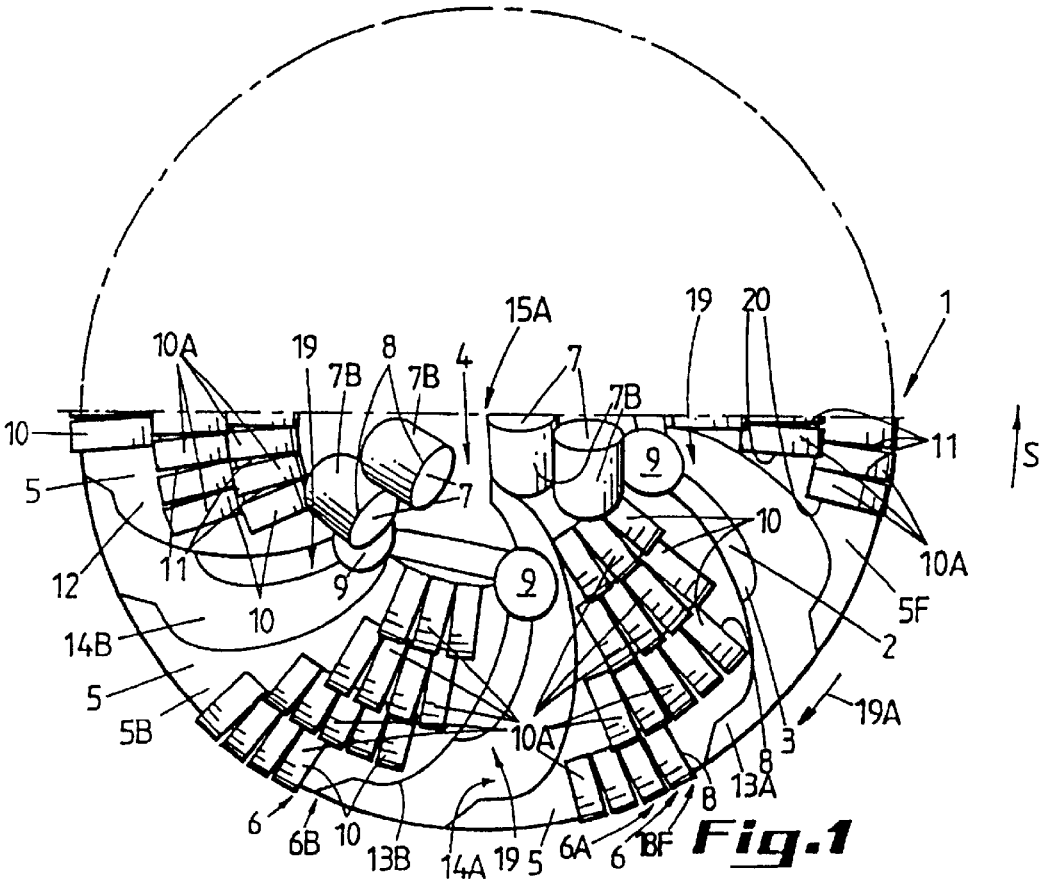
FIG. 1 shows schematically in a half plane view, as tool, a drill bit of the invention.
Figure 2:
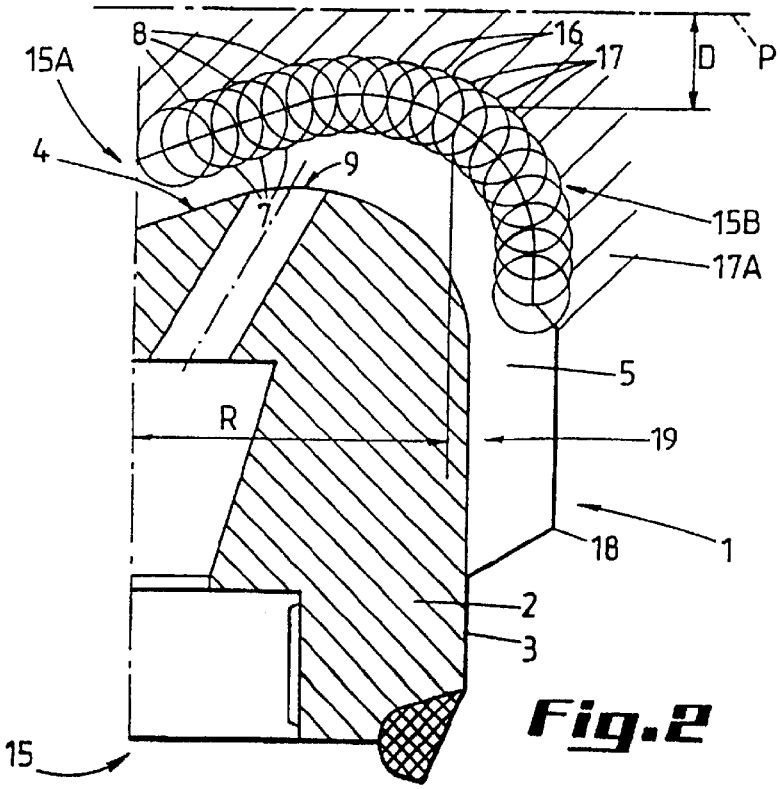
FIG. 2 shows schematically, in an axial section, a superposition of the projections of all the PDC and secondary cutting elements of the different blades of a drill tool in the half section plane after an adequate rotation around the rotation axis.
Figure 3:
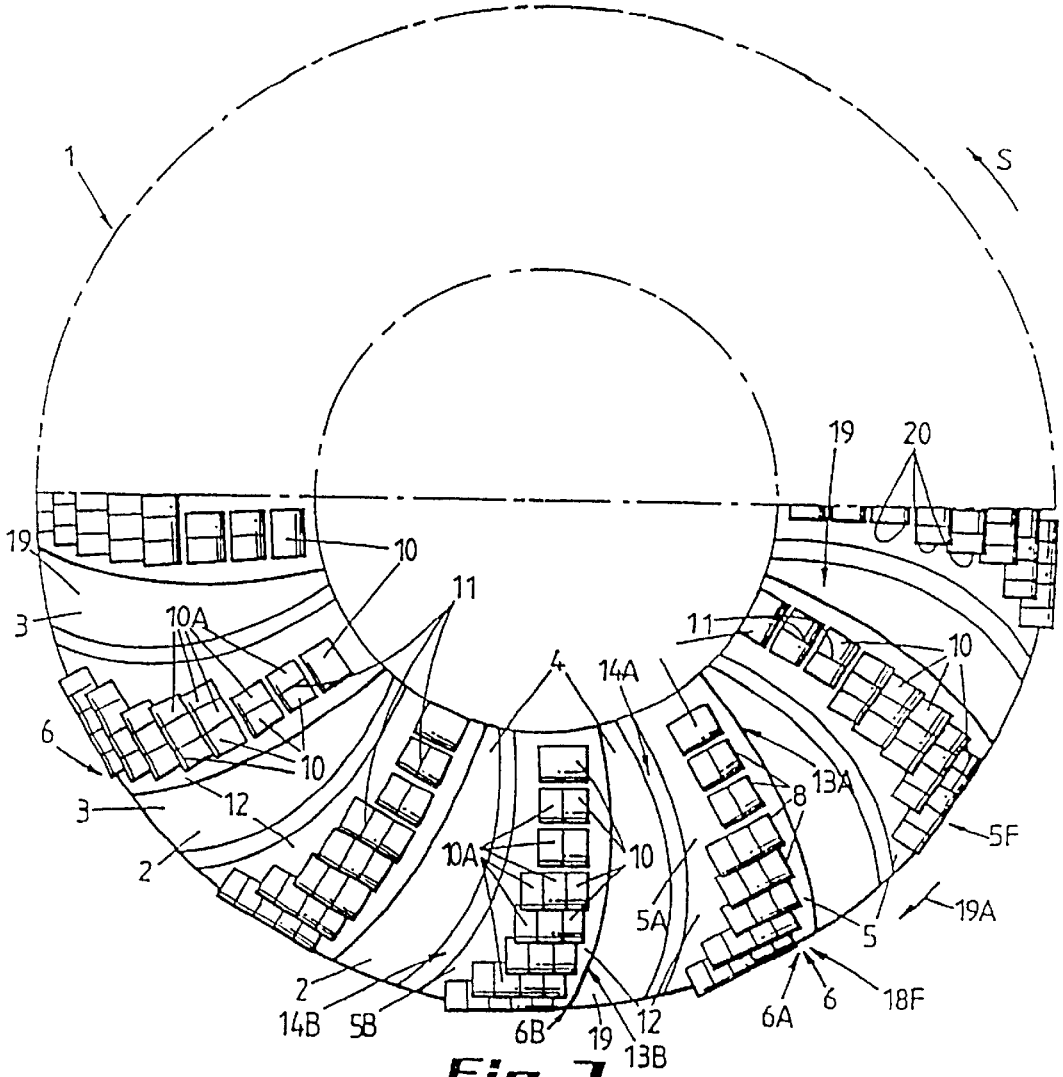
FIG. 3 shows schematically in a half plane view, as tool, a core bit of the invention.

As shown in FIGS. 1, 2 and 3, the tool 1 of the invention comprises in a known way a body 2 showing a substantially cylindrical peripheral surface 3 and a front 4 when considering a drilling and/or coring direction. Blades 5 extend from the front 4 until over the peripheral surface 3 and show each a leading edge 6 for the drilling and/or coring.

PDC cutting elements 7 (Poly crystalline Diamond Compact) are situated at least in the central area 15A and are arranged to have their longitudinal axes directed transversally to the rotation axis of the tool 1.

PDC elements 7C can be divided along the leading edge 6 of each blade 5; they show each a cutting edge 8 forming together the leading edge 6.

According to FIG. 1, the elements which are divided along each leading edge 6 and which show each on this edge a cutting edge 8, are secondary elements 10. According to the invention, it is also possible to conceive any mixing of secondary elements 10 and PDC elements 7C along same leading edge 6.

By secondary cutting element 10, it can be understood here a cutting element arranged outside the central area 15A, and the cutting edge 8 of which is part of the leading edge 6. Such a secondary element 10 can be made by sintering and may comprise abrasive grits and a metallic bond.

Usually, nozzles 9 (FIGS. 1 and 2, not shown in FIG. 3) are provided on the front 4 in order to supply an adequate liquid there through to the bottom of the hole during the operation.

According to the invention, the tool 1 comprises moreover, behind at least one PDC cutting element 7C (FIG. 5) or one secondary element 10 (FIG. 1), when considering a drilling rotation S of the tool 1, at least one cutting element 10A associated to element 7C or 10, which has a cross-section of the same shape, at least for its part protruding from the blade 5, than that of this latter element and which is disposed on the same blade 5 as the element 7C or 10 to which it is associated. Moreover, a cutting edge 11 of the associated element 10A is situated at the most on a same radial distance R (FIG. 2) of the rotation axis and at least on a same distance D, measured parallel to this rotation axis starting from a plane P perpendicular to this axis and situated in front of the tool 1, than the cutting edge 8 of the associated PDC 7C or secondary 10 element. The associated element or elements 10A can thus be set back with respect to the elements 7C or 10 (FIG. 6) as regards the formation to be drilled or cored.

In this way, if the PDC 7C or secondary 10 element wears off or is torn away from the tool 1 or is broken, the associated element 10A, "hidden" until then behind this element 7C or 10, may come in action and practically no effect will be felt on the drilling and/or coring efficiency.

Figure 5:
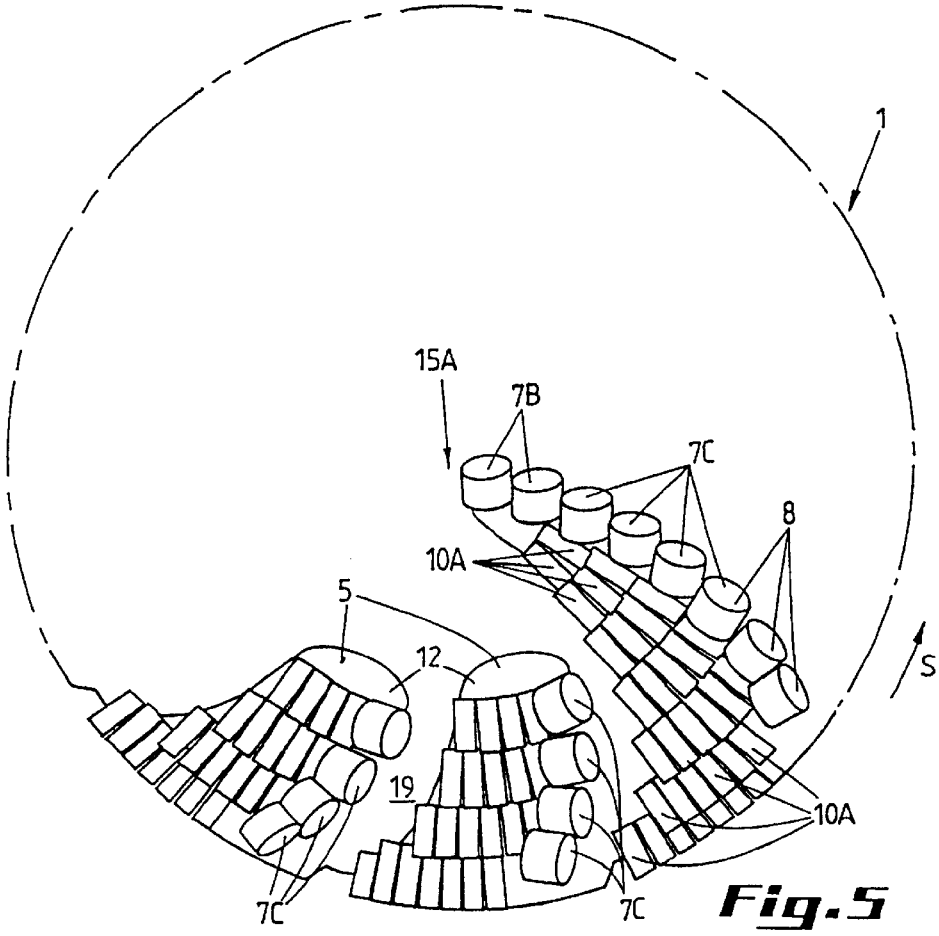
FIG. 5 shows schematically, in a partial plane view, another embodiment of a drill bit as tool of the invention.

FIGS. 1 and 5 show for example that beyond a certain diameter around the rotation axis, one or more associated elements 10A are thus situated behind each PDC 7C or secondary 10 element arranged on the leading edge 6 of a same blade 5. It can also be seen that the associated PDC 7 and secondary 10 elements form then each time a portion of a ring centred on the rotation axis.

The majority of the PDC cutting elements 7 or 7C being usually cylindrical, it may be preferred that the secondary 10 and/or associated 10A elements are also cylindrical and show then advantageously a diameter equal to that of the corresponding PDC element 7C. The diameters of the PDC 7, 7C, secondary 10 and/or associated 10A elements can either all be equal or different one with respect to the other, for example in function of their distance with respect to the rotation axis.

In the case of the core bit 1 of FIG. 3, the cutting elements 10 which are the closest to the rotation axis are illustrated as having a same diameter and a same orientation around this axis as the other cutting elements 10 situated further away from the rotation axis. Moreover, these closest elements 10 are illustrated as having a length greater than that of the other elements 10 situated further away from the rotation axis. However, they could have the same length as these latter elements. Usually, the core bit 1 does not comprise PDC cutting elements 7.

In the case of the drill bit 1 of FIG. 1, the PDC cutting elements 7B which are the closest to the rotation axis are illustrated as being directed each transversally (mounted for example on known intermediary studs) with respect to a corresponding axial plane. PDC elements 7C (FIG. 5) such as those situated on diameters greater than said determined diameter around the rotation axis, can also be mounted in such a manner on the blades 5 that their longitudinal axis is inclined with respect to a plane (that of the drawing) perpendicular to the rotation axis in such a manner that their end face comprising the cutting edge 8 is turned somewhat towards a bottom of the hole to be drilled or towards the formation 17A to be drilled.

In the case of FIG. 2, all the PDC 7C or secondary 10 and associated 10A cutting elements have a same diameter and, on a same blade 5, the associated elements 10A situated at a same radial distance R as the corresponding secondary 10 or PDC 7C element are maximally at a same distance D, parallel to the rotation axis, as this PDC element 7 with respect to the perpendicular plane P.

Figure 4:
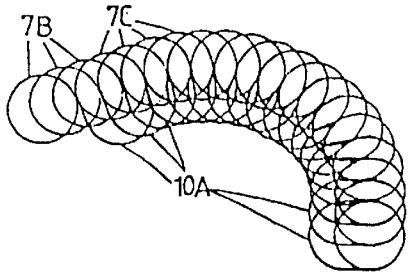
FIG. 4 shows schematically, in the same way as FIG. 2 but simplified, the projections of the circular PDC cutting elements and oblong secondary cutting elements of different blades.
Figure 6:
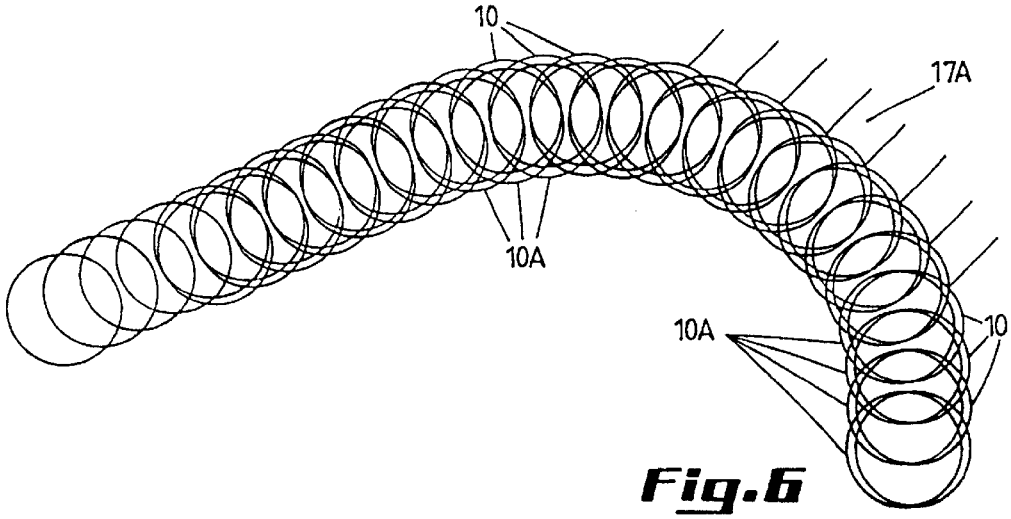
FIG. 6 shows schematically, in the way of FIG. 4 but on another scale, a projection, in a half axial plane, of the cutting elements of the various blades of a drill bit of the invention.

The PDC 7C, secondary 10 and associated 10A elements have been illustrated hereinabove as being cylindrical (FIGS. 2 and 6). However, at least certain associated elements 10A could show other cross-sections, for example oblong, elliptic or oval (FIG. 4), the large axis of the oval or the ellipse may then be advantageously substantially perpendicular to a plane tangential to an envelope 15B of the cutting elements 7, 10, 10A at the place of contact between the cutting edge 11 of the associated element 10A in question and this envelope 15B. Oblong associated elements 10A of this kind increase what can be called the volume of abrasive material per active surface unit of the tool 1, given the reserve that is accumulated thereby in the depth in the tool 1 and which can be used. However, it appears that circular associated elements 10A increase already considerably this volume with respect to the case of the so-called impregnated tools.

In the tool 1 of the invention, the PDC 7C (FIG. 5) or secondary 10 (FIGS. 1 and 3) cutting elements and the adjacent associated elements 10A are preferably practically coupled to one another by their end faces which are directed towards each other. Possible interstices between two adjacent associated cutting elements 7C, 10, 10A, for example as a result of the curvature of the tool 1 seen in a secant plane perpendicular to the rotation axis, can be filled in a way which is usual in the art (infiltration material, adequate mastic, etc.).

Advantageously, the leading edge 6 of each blade 5 of the tool 1 of the invention shows on the whole a helical shape with a diameter which varies from the rotation axis or from its extremity the closest thereto, over the front 4, till its opposite extremity situated on the cylindrical peripheral surface 3 of the body 2. This helix may turn either in the same direction or in the opposite direction of the rotation direction S during drilling as it diverges from the rotation axis and/or from the front 4. For example, according to whether one wishes to evacuate the fragments drawn out of a bottom of the hole by the cutting elements 7, 10, 10A rather quickly, the blades 5 can be made to function in a way of an Archimedian screw or an auger bit as shown in FIG. 1. Moreover, in a plane view, the leading edge 6 may start radially, or close to the rotation axis even in the rotation direction S of the tool, and may deviate subsequently to be directed in the opposite direction of said rotation direction S.

As shown in FIGS. 1, 2, 3 and 5, each blade 5 may protrude from the body 2 and may present, as outer surface, a portion of a revolution surface 12 wherein PDC 7C or secondary 10 and associated 10A cutting elements are implanted and which is delimited by anterior 13 and posterior 14 (according to the rotation direction S during drilling or coring) lateral faces which, in projection (FIGS. 1, 3 and 5), follow the helical shape of a corresponding leading edge 6. So, the anterior lateral face 13A of a blade 5A follows the shape of the leading edge 6A of this same blade 5A whereas the posterior lateral face 14A of this blade 5A follows rather the shape of the leading edge 6B of the following blade 5B or further an intermediary path between those of the leading edges 6A and 6B.

Advantageously, the width of the surface portion 12 and hence the width of the blade 5, measured in a projection plane perpendicular to the rotation axis, increases as one moves away from this latter axis over the front 4 and/or as one moves away from this front, over the peripheral surface 2, in the direction of a back 15 (FIG. 2) of the tool 1.

As the width of a blade 5 increases like hereinabove, the number of associated cutting elements 10A arranged one behind the other and behind a cutting element 7C, 10 on the blade 5, at a same level D taken parallel to the rotation axis and with respect to a plane P which is perpendicular thereto, may increase progressively with one associated element 10A. It may be preferred that all the PDC 7C and/or secondary 10 and/or associated 10A elements have the same length. However, it may also be advantageous, for example in order to follow the increase of the width, of the blades 5 better, that at least certain associated elements 10A of a blade 5 have different lengths, for example equal to half the length of the other cutting elements 7C, 10, 10A arranged in line at a same level D on a blade 5.

The secondary 10 and/or associated 10A cutting elements are advantageously made of a less expensive material than that of the PDC elements 7. The secondary 10 and/or associated 10A elements are for example made of a composite material containing abrasive particles. This may be sintered or infiltrated tungsten carbide, known by the man skilled in the art, possibly comprising diamond particles.

However, certain so-called associated elements 10A can also be made of PDC and arranged for example between two other associated elements 10A of a composite material which is less expensive than PDC, in a same line and at a same level on a blade 5. Secondary 10 and/or associated 10A elements can also be made of what is called in the art thermally stable synthetic diamond.

The secondary 10 and/or associated 10A elements may have mutually different hardnesses, for example according to their position on the tool 1, and may also contain variable percentages (by volume) of abrasive and/or diamond particles.

As shown in particular in FIG. 1, at least one blade 5 may extend until in a central area 15A of the front 4 and one of the blades 5 may have there a PDC cutting element 7B which acts practically in the middle of this front 4. In this central area 15A, the blade or blades 5 may preferably comprise only PDC cutting elements 7B without associated cutting element 10A. Blade 5A may for example be closer to the rotation axis than the other blades 5 and may have a reduced width in this central area 15A Other blades, such as SB may start outside the central area 15A and may have as from their start a width such that several cutting elements 7C or 10 and 10A can be arranged thereon in line at a first level D the most to the front of this blade 5B.

On the front 4 spaces can be made between the different blades 5 to arrange nozzles 9 therein. Drilling (FIG. 1) and/or coring liquid ducts can be provided in the usual way in the tool 1. The outlet nozzles 9 for this liquid may be of a type to be screwed in the tool 1 so as to be exchangeable in function of their outlet dimensions and hence of the liquid flow rate towards the bottom of a hole which is being drilled.

However, the nozzles 9 can be formed by prefabricated elements. During the manufacturing of a tool 1 by moulding, these prefabricated elements can then be placed in locations provided in the mould at the same time as PDC 7, secondary 10 and associated 10A cutting elements are placed therein in adequate locations. The mould is then filled in a usual way with solid elements and powdery materials which form in a way known per se, after infiltration with a liquid metal in this mass, the body 2 and the actual blades 5, the liquid metal fixing thus at the same time the prefabricated elements and the cutting elements 7, 10, 10A to the blades 5 produced in this way.

Of course, from one blade 5 to the other, the cutting elements 7, 10, 10A are arranged at levels D and distances R from the rotation axis chosen so that in a projection in a plane passing through the rotation axis (FIGS. 2, 4 and 6), the cutting elements 7, 10, 10A are complementary to one another to form on the bottom of a drilled or cored hole an envelope 15B of leading edges 6 which is as regular as possible, without leaving high circular projections 16 between two circular grooves 17 drawn by the cutting edges 8, 11 of the whole of the leading edges 6 in the formation 17A to be drilled or cored.

It has to be understood that the invention is in no way limited to the described embodiments and that many modifications can be applied thereto without departing from the scope of the present invention.

In this way, the front 4 of the drill tool 1 (FIG. 2) is preferably concave in the central area 15A and the cutting elements 7, 10, 10A are disposed therein to cut a drill hole bottom which is substantially conical with a low gradient, for example between 10° and 30° with respect to a plane perpendicular to the rotation axis, the cone pointing towards the back 15 of the tool 1 in the working position. A gradient of 20° may be preferred.

Moreover, the helical blades 5 are advantageously arranged on the peripheral surface 3 in such a manner that, seen according to the projection of FIG. 1, a blade 5A covers the posterior extremity 18F of a blade 5F which extends (in the case of this figure) according to arrow 19A until below the part of blade 5A which is visible in this view, and the same for the others. So, there is assured an uninterrupted rolling, without chocks (and hence improved), of the tool 1 against a wall, for example of the hole which is being drilled.

In the projection of FIG. 1, the helix described in the case of the drill tool 1 can be considered as being, on the front 4, a part of a spiral followed, on the peripheral surface 3, by an actual helix.

Each time between two blades 5 a channel 19 (FIGS. 1 and 2) is provided which becomes advantageously wider at least as from its extremity which is the closest to the rotation axis and possibly until a predetermined width is achieved, for example to the extent that the blades 5 which border it become larger.

The secondary 10 and/or associated 10A cutting elements have preferably their (anterior and/or posterior) end faces 20 parallel to the rotation axis of the tool 1. These end faces 20 may form an angle with a radius starting from this rotation axis and going through any of their points.

How to implement the invention to a core bit will be understood after having read the preceding part and after having examined the corresponding FIG. 3 wherein possible coring liquid nozzles have not been shown. One will notice in particular a shift in radial distance between the first cutting element 10 of a blade 5 and the one of the following blade, and thus of the following cutting elements 10, 10A on each blade 5. The elements which are the closest to the rotation axis can be arranged with their longitudinal axis perpendicular to the rotation axis, as shown, or may show a particular inclination so that the cutting edge 8 forms a predetermined cutting angle with the formation 17A to be drilled.

LIST OF REFERENCES

1. Tool
2. Body
3. Peripheral surface of 2
4. Front of 2
5. Blade (of which in particular the blades 5A, 5B, 5F are indicated)
6. Leading edge of 5 (of which in particular the edges 6A, 6B of the corresponding blades are indicated)
7. PDC cutting element (of which also variants 7B and 7C are indicated in function of their relative positions)
8. Cutting edge of 7, 10
9. Nozzle

10. Secondary cutting element
10A. Associated cutting element
11. Cutting edge of 10A
12. Revolution surface portion of 5
13. Anterior lateral face of 5 (of which in particular 13A of the corresponding blade 5A is indicated)
14. Posterior lateral face of 5 (of which in particular 14A of the corresponding blade 5A is indicated)
15. Back of 1
15A Central area of 4
15B. Envelope
16. Projections
17. Grooves
17A. Formation
18. Posterior extremity of 5 (of which in particular 18F of the corresponding blade 5F is indicated)
19. Channel
19A. Arrow
20. End faces of 10, 10A
P Perpendicular plane in front of the tool 1
D Distance from P
R Radial distance
S Rotation direction of the tool 1.

What is claimed is:

1. A drill or core tool for oil drilling or coring, comprising:

a body (2) showing a substantially cylindrical peripheral surface (3) and a front (4), considered in a movement direction during drilling or coring, blades (5) which extend from the front (4) till over the peripheral surface (3) and which show each leading edge (6) for the drilling or coring, PDC cutting elements (7) which are situated at least in a central area (15A) of the front (4) and the longitudinal axis of which are transverse to the rotation axis of the tool(1), and nozzles (9) for supplying a drilling liquid, characterized in that it comprises moreover, on at least one blade (5), outside said central area (15A), PDC cutting elements (7C) and/or secondary cutting elements (10) which show each a cutting edge (8), forming together the leading edge (6) of the blade (5), and the longitudinal axis of which is transverse to the rotation axis, and at least one associated cutting element (10A)

which is situated, when considering a drilling rotation (S) of the tool (1), behind at least one of the PDC (7C) or secondary (10) cutting elements, which shows a cross-section of the same shape, at least for its portion protruding from the blade (5), as that of the PDC (7C) or secondary (10) cutting element, which is disposed on the same blade (5), an edge (11) of which destined for cutting is situated at the most on a same radial distance (R) from the rotation axis and at least on a same distance (D), measured parallel to this rotation axis starting from a plane (P) perpendicular to this axis and situated in front of the tool (1), as that of the cutting edge (8) of said PDC (7C) or secondary (10) element, and further characterized in that the associated cutting element (10A) is practically coupled by an end face to the adjacent end face of the PDC (7C) or secondary (10) or associated (10A) cutting element which is situated immediately next thereto on the same blade (5) and substantially on the same of said distances (D, R).

2. A tool as defined in claim 1 characterized in that the secondary (10) and/or associated (10A) cutting elements are elements which are prefabricated by sintering and which comprise abrasive grits and a metallic bond.

3. A tool as defined in claim 1 further characterized in that the leading edge (6) of the blades (5) has the shape of a helix with a variable radius and which turns, at least along said peripheral surface (3), either in the direction opposite to the drilling rotation (S) or in the same direction as it moves away from the front (4).

4. A tool as defined in claim 2 further characterized in that the leading edge (6) of the blades (5) has the shape of a helix with a variable radius and which turns, at least along said peripheral surface (3), either in the direction opposite to the drilling rotation (S) or in the same direction as it moves away from the front (4).

5. A tool as defined in claim 1 further characterized in that the width of a blade (5), taken in a projection plane perpendicular to the rotation axis, increases as one moves away from this rotation axis over the front (4), and/or from this front in the direction of a back (15) of the tool (1).

6. A tool as defined in claim 2 further characterized in that the width of a blade (5), taken in a projection plane perpendicular to the rotation axis, increases as one moves away from this rotation axis over the front (4), and/or from this front in the direction of a back (15) of the tool (1).

7. A tool as defined in claim 1 further characterized in that secondary (10) and/or associated (10A) cutting element are made of a composite material containing abrasive particles.

8. A tool as defined in claim 2 further characterized in that secondary (10) and/or associated (10A) cutting element are made of a composite material containing abrasive particles.

9. A tool as defined in claim 1 further characterized in that secondary (10) and/or associated (10A) elements are thermally stable synthetic diamonds.

10. A tool as defined in claim 2 further characterized in that secondary (10) and/or associated (10A) elements are thermally stable synthetic diamonds.

11. A tool as defined in claim 1 further characterized in that the nozzles (9) are composed of prefabricated elements placed in locations provided in a production mould, at the same time as the PDC (7) and/or secondary (10) and associated (10A) cutting elements are placed therein in adequate locations, the mould being subsequently filled with solid elements and powdery materials which form, after infiltration of liquid metal, the body (2) and the actual blades (5).

12. A tool as defined in claim 2 further characterized in that the nozzles (9) are composed of prefabricated elements placed in locations provided in a production mould, at the same time as the PDC (7) and/or secondary (10) and associated (10A) cutting elements are placed therein in adequate locations, the mould being subsequently filled with solid elements and powdery materials which form, after infiltration of liquid metal, the body (2) and the actual blades (5).

13. A tool as defined in claim 1 further characterized in that at least one blade (5) extends in the central area (15A) of the front (4) and comprises at least one of the PDC cutting elements (7) arranged for acting in the middle of this front (4), the cutting edge (8) of this PDC cutting element (7) pertaining to the leading edge (6) of said blade (5).

14. A tool as defined in claim 2 further characterized in that at least one blade (5) extends in the central area (15A) of the front (4) and comprises at least one of the PDC cutting elements (7) arranged for acting in the middle of this front (4), the cutting edge (8) of this PDC cutting element (7) pertaining to the leading edge (6) of said blade (5).

15. A tool as defined in claim 1 further characterized in that, in the central area (15A), the front (4) is concave and in that the cutting elements (7, 10, 10A) are disposed therein to cut out a drill hole bottom of a substantially conical shape with a low gradient with respect to a plane perpendicular to the rotation axis.

16. A tool as defined in claim 2 further characterized in that, in the central area (15A), the front (4) is concave and in that the cutting elements (7, 10, 10A) are disposed therein to cut out a drill hole bottom of a substantially conical shape with a low gradient with respect to a plane perpendicular to the rotation axis.

17. A tool as defined in claim 1 further characterized in that at least one associated cutting element (10) has an oblong cross-section and in that the largest dimension of this cross-section is preferably directed substantially perpendicularly to a plane tangential to an envelope (15B) of the cutting elements (7, 10, 10A) at the place of contact between the cutting edge (11) of the concerned associated element (10A) and said envelope (15B).

18. A tool as defined in claim 2 further characterized in that at least one associated cutting element (10) has an oblong cross-section and in that the largest dimension of this cross-section is preferably directed substantially perpendicularly to a plane tangential to an envelope (15B) of the cutting elements (7, 10, 10A) at the place of contact between the cutting edge (11) of the concerned associated element (10A) and said envelope (15B).

19. A tool as defined in claim 1 further characterized in that the longitudinal axis of at least certain of the PDC (7) and/or secondary (10) cutting elements show an inclination with respect to a plane perpendicular to the rotation axis in such a manner that their end face comprising the cutting edge (8) is turned somewhat to a bottom of the hole to be drilled.

20. A tool as defined in claim 2 further characterized in that the longitudinal axis of at least certain of the PDC (7) and/or secondary (10) cutting elements show an inclination with respect to a plane perpendicular to the rotation axis in such a manner that their end face comprising the cutting edge (8) is turned somewhat to a bottom of the hole to be drilled.

21. A tool as defined in claim 1 further characterized in that the longitudinal axis of at least certain secondary (10) and/or associated (10A) elements is comprised each time in a plane perpendicular to the rotation axis.

22. A tool as defined in claim 2 further characterized in that the longitudinal axis of at least certain secondary (10) and/or associated (10A) elements is comprised each time in a plane perpendicular to the rotation axis.

23. A drill or core tool for oil drilling or coring, comprising:

a body (2) showing a substantially cylindrical peripheral surface (3) and a front (4), considered in a movement direction during drilling or coring, blades (5) which extend from the front (4) till over the peripheral surface (3) and which show each leading edge (6) for the drilling or coring, PDC cutting elements (7) which are situated at least in a central area (15A) of the front (4) and the longitudinal axis of which are transverse to the rotation axis of the tool (1), and nozzles (9) for supplying a drilling liquid, characterized in that it comprises moreover, on at least one blade (5), outside said central area (15A), PDC cutting elements (7C) and/or secondary cutting elements (10) which show each a cutting edge (8), forming together the leading edge (6) of the blade (5), and the longitudinal axis of which is transverse to the rotation axis, and at least one associated cutting element (10A)

which is situated, when considering a drilling rotation (S) of the tool (1), behind at least one of the PDC (7C) or secondary (10) cutting elements, which shows a cross-section of the same shape, at least for its portion protruding from the blade (5), as that of the PDC (7C) or secondary (10) cutting element, which is disposed on the same blade (5), an edge (11) of which destined for cutting is situated at the most on a same radial distance (R) from the rotation axis and at least on a same distance (D), measured parallel to this rotation axis starting from a plane (P) perpendicular to this axis and situated in front of the tool (1), as that of the cutting edge (8) of said PDC (7C) or secondary (10) element, and characterized further in that the width of a blade (5), taken in a projection plane perpendicular to the rotation axis, increases as one moves away from this rotation axis over the front (4), and/or from this front in the direction of a back (15) of the tool (1), and characterized further in that the number of associated cutting element (10A) arranged one behind the other on a same blade (5) and on the same of said distances (D, R) radial and parallel to the rotation axis, increases progressively with one associated cutting element (10A) having a length equal to the length of said secondary cutting elements (10), as the width of the blade (5) increases.

24. A tool as defined in claim 23 characterized in that the secondary (10) and/or associated (10A) cutting elements are elements which are prefabricated by sintering and which comprise abrasive grits and a metallic bond.

25. A tool as defined in claim 23 further characterized in that secondary (10) and/or associated (10A) cutting element are made of a composite material containing abrasive particles.

26. A tool as defined in claim 24 further characterized in that secondary (10) and/or associated (10A) cutting element are made of a composite material containing abrasive particles.

27. A tool as defined in claim 23 further characterized in that secondary (10) and/or associated (10A) elements are thermally stable synthetic diamonds.

28. A tool as defined in claim 24 further characterized in that secondary (10) and/or associated (10A) elements are thermally stable synthetic diamonds.

29. A tool as defined in claim 23 further characterized in that the nozzles (9) are composed of prefabricated elements placed in locations provided in a production mould, at the same time as the PDC (7) and/or secondary (10) and associated (10A) cutting elements are placed therein in adequate locations, the mould being subsequently filled with solid elements and powdery materials which form, after infiltration of liquid metal, the body (2) and the actual blades (5).

30. A tool as defined in claim 24 further characterized in that the nozzles (9) are composed of prefabricated elements placed in locations provided in a production mould, at the same time as the PDC (7) and/or secondary (10) and associated (10A) cutting elements are placed therein in adequate locations, the mould being subsequently filled with solid elements and powdery materials which form, after infiltration of liquid metal, the body (2) and the actual blades (5).

31. A tool as defined in claim 23 further characterized in that at least one blade (5) extends in the central area (15A)

of the front (4) and comprises at least one of the PDC cutting elements (7) arranged for acting in the middle of this front (4), the cutting edge (8) of this PDC cutting element (7) pertaining to the leading edge (6) of said blade (5).

32. A tool as defined in claim 24 further characterized in that at least one blade (5) extends in the central area (15A) of the front (4) and comprises at least one of the PDC cutting elements (7) arranged for acting in the middle of this front (4), the cutting edge (8) of this PDC cutting element (7) pertaining to the leading edge (6) of said blade (5).

33. A tool as defined in claim 23 further characterized in that, in the central area (15A), the front (4) is concave and in that the cutting elements (7, 10, 10A) are disposed therein to cut out a drill hole bottom of a substantially conical shape with a low gradient with respect to a plane perpendicular to the rotation axis.

34. A tool as defined in claim 24 further characterized in that, in the central area (15A), the front (4) is concave and in that the cutting elements (7, 10, 10A) are disposed therein to cut out a drill hole bottom of a substantially conical shape with a low gradient with respect to a plane perpendicular to the rotation axis.

35. A tool as defined in claim 23 further characterized in that at least one associated cutting element (10) has an oblong cross-section and in that the largest dimension of this cross-section is preferably directed substantially perpendicularly to a plane tangential to an envelope (15B) of the cutting elements (7, 10, 10A) at the place of contact between the cutting edge (11) of the concerned associated element (10A) and said envelope (15B).

36. A tool as defined in claim 24 further characterized in that at least one associated cutting element (10) has an oblong cross-section and in that the largest dimension of this cross-section is preferably directed substantially perpendicularly to a plane tangential to an envelope (15B) of the cutting elements (7, 10, 10A) at the place of contact between the cutting edge (11) of the concerned associated element (10A) and said envelope (15B).

37. A tool as defined in claim 23 further characterized in that the longitudinal axis of at least certain of the PDC (7) and/or secondary (10) cutting elements show an inclination with respect to a plane perpendicular to the rotation axis in such a manner that their end face comprising the cutting edge (8) is turned somewhat to a bottom of the hole to be drilled.

38. A tool as defined in claim 24 further characterized in that the longitudinal axis of at least certain of the PDC((7) and/or secondary (10) cufting elements show an inclination with respect to a plane perpendicular to the rotation axis in such a manner that their end face comprising the cutting edge (8) is turned somewhat to a bottom of the hole to be drilled.

39. A tool as defined in claim 23 further characterized in that the longitudinal axis of at least certain secondary (10) and/or associated (10A) elements is comprised each time in a plane perpendicular to the rotation axis.

40. A tool as defined in claim 24 further characterized in that the longitudinal axis of at least certain secondary (10) and/or associated (10A) elements is comprised each time in a plane perpendicular to the rotation axis.

41. A drill or core tool for oil drilling or coring, comprising:

a body (2) showing a substantially cylindrical peripheral surface (3) and a front (4), considered in a movement direction during drilling or coring, blades (5) which extend from the front (4) till over the peripheral surface (3) and which show each leading edge (6) for the drilling or coring, PDC cutting elements (7) which are situated at least in a central area (15A) of the front (4) and the longitudinal axis of which are transverse to the rotation axis of the tool(1), and nozzles (9) for supplying a drilling liquid, characterized in that it comprises moreover, on at least one blade (5), outside said central area (15A), PDC cutting elements (7C) and/or secondary cutting elements (10) which show each a cutting edge (8), forming together the leading edge (6) of the blade (5), and the longitudinal axis of which is transverse to the rotation axis, and at least one associated cutting element (10A)

which is situated, when considering a drilling rotation (S) of the tool (1), behind at least one of the PDC (7C) or secondary (10) cutting elements, which shows a cross-section of the same shape, at least for its portion protruding from the blade (5), as that of the PDs (7C) or secondary (10) cutting element, which is disposed on the same blade (5), an edge (11) of which destined for cutting is situated at the most on a same radial distance (R) from the rotation axis and at least on a same distance (D), measured parallel to this rotation axis starting from a plane (P) perpendicular to this axis and situated in front of the tool (1), as that of the cutting edge (8) of said PDC (7C) or secondary (10) element, further characterized in that the PDC cutting elements (7) and/or the secondary (10) and/ or associated (10A) cutting elements are cylindrical and have equal diameters, and further characterized in that the associated cutting element (10A) is practically coupled by an end face to the adjacent end face of the PDC (7C) or secondary (10) or associated (10A) cutting element which is situated immediately next thereto on the same blade (5) and substantially on the same of said distances (D, R).

42. A tool as defined in claim 41 further characterized in that the secondary (10) and/or associated (10A) cutting elements are elements which are prefabricated by sintering and which comprise abrasive grits and a metallic bond.

43. A bit for cutting into a formation comprising:

an axially extending bit body adapted to be rotated in a forward cutting motion to cut into a formation, said bit body having a substantally cylindrical peripheral surface with a forward drilling face at a front axial end and a rearward connection area at a rear axial end, blades extending substantially radially along the forward drilling face and substantially axially along the peripheral surface of said body, a leading edge on the blades, said edge leading relative to the direction of forward cutting motion of the bit body, leading cutting elements situated along the leading edge of the blades, said leading cutting elements adapted to cut a path through the formation as the bit body is rotated in a forward motion, associated cutting elements situated behind leading cutting elements on the same blades, the associated cutting elements having a central cutter axis with a mounting section adapted to be received within a bit blade for securing the associated cutting element to the blade and a cutting section extending away from the blade for cutting the formation, the associated cutting elements being associated with a leading cutting element, said mounting section and said cutting section of each said associated cutting element having the same physical construction and composition, and said associated cutting element being disposed on the blade with its central cutter axis extending substantially in the direction of rotating motion of the bit body with at least a portion of the cutting section disposed to trail in the groove cut by the associated leading cutter element.

44. A bit as defined in claim 43 wherein a portion of each associated cutting element is buried in the blade to secure the associated cutting element to the bit body and wherein the associated cutting element thus secured has a substantially uniform thickness and a cross section, taken along a plane disposed at a right angle to said central cutter axis, that is substantially circular, oblong, elliptic or oval with a portion of a correspondingly shaped cutting face at least partially presented to the formation in the direction of bit rotation.

45. A bit as defined in claim 43 wherein the leading cutting elements comprise polycrystalline diamond compacts (PDC) cutting elements and the associated cutting elements are comprised of a composite material containing abrasive particles.

46. A bit as defined in claim 43 wherein the blades increase in width in a direction from said forward drilling face toward said rearward connection area.

47. A bit as defined in claim 43 wherein multiple associated cutting elements are associated with each other and a leading cutting element on the same blade and at least a portion of each multiple associated cutting element is disposed to trail in the groove cut by one of the cutting elements with which it is associated.

48. A bit as defined in claim 47 wherein the blades increase in width in a direction from said forward drilling face toward the rearward connection area.

49. A bit as defined in claim 48 wherein the number of associated cutting elements associated with a leading cutting element on the same blade increases as the width of the blade increases.

50. A bit as defined in claim 47 wherein said blades have a variable width and an increasing number of multiple associated cutting elements is associated with a leading cutting element on the same blade as the width of the blade increases.

51. A bit as defined in claim 44 wherein the blades increase in width in a direction from said forward drilling face toward said rearward connection area.

52. A bit as defined in claim 44 wherein said blades have a variable width and an increasing number of multiple associated cutting elements is associated with a leading cutting element on the same blade as the width of the blade increases.

53. A bit as defined in claim 43 wherein:

a portion of each associated cutting element is buried in the blade to secure the associated cutting element to the bit body and wherein the associated cutting element thus secured has a cross section, taken along a plane disposed at a right angle to said central cutter axis, that is substantially circular, oblong, elliptic or oval, the leading cutting elements comprise polycrystalline diamond compacts (PDC) cutting elements and the associated cutting elements are comprised of a composite material containing abrasive particles, the blades increase in width in a direction from said forward drilling face toward said rearward connection area, multiple associated cutting elements are associated with each other and a leading cutting element on the same blade and at least a portion of each multiple associated cutting element is disposed to trail in the groove cut by one of the cutting elements with which it is associated, and the number of associated cutting elements associated with a leading cutting element on the same blade increases as the width of the blade increases.

54. A bit as defined in claim 53 wherein the associated cutting elements are prefabricated elements disposed in locations provided in a mold used to form the bit body whereby the associated elements are fixed to the bit body by liquid metal infiltration during the fabrication of the bit body.

55. A bit as defined in claim 54 wherein the associated cutting elements are cylindrical disk bodies comprising sintered or infiltrated tungsten carbide containing diamond particles or thermally stable synthetic diamond particles.

* * * * *

UNITED STATES PATENT AND TRADEMARK OFFICE

CERTIFICATE OF CORRECTION

PATENT NO. : 6,283,233 B1
DATED : September 4, 2001
INVENTOR(S) : Etienne Lamine et al.

It is certified that error appears in the above-identified patent and that said Letters Patent is hereby corrected as shown below:

Column 11,
Line 47, delete "((7)" and insert therefor -- (7) --.
Line 48, delete "cufting" and insert therefor -- cutting --.

Column 12,
Line 19, delete "PDs" and insert therefor -- PDC --.

Signed and Sealed this

Nineteenth Day of March, 2002

*Attest:*

*Attesting Officer*

JAMES E. ROGAN
*Director of the United States Patent and Trademark Office*